US007470117B2

(12) United States Patent
Shafer et al.

(10) Patent No.: US 7,470,117 B2
(45) Date of Patent: Dec. 30, 2008

(54) VARIABLE DISCHARGE FUEL PUMP

(75) Inventors: Scott F. Shafer, Morton, IL (US); Brad E. Bartley, Manito, IL (US); Kevin Charles Reynolds, Maidstone (GB); Gregory W. Hefler, Chillicothe, IL (US)

(73) Assignee: Caterpillar Inc., Peoria, IL (US)

( * ) Notice: Subject to any disclaimer, the term of this patent is extended or adjusted under 35 U.S.C. 154(b) by 461 days.

(21) Appl. No.: 10/998,624

(22) Filed: Nov. 30, 2004

(65) Prior Publication Data

US 2006/0120880 A1 Jun. 8, 2006

(51) Int. Cl.
*F04B 23/04* (2006.01)
*F04B 41/06* (2006.01)

(52) U.S. Cl. ..... 417/533; 417/531; 417/307

(58) Field of Classification Search ..... 417/245, 417/531, 533, 307; 123/506
See application file for complete search history.

(56) References Cited

U.S. PATENT DOCUMENTS

| | | | | |
|---|---|---|---|---|
| 3,572,847 | A | 3/1971 | Luft | |
| 3,945,784 | A * | 3/1976 | Collins | 425/130 |
| 4,119,355 | A | 10/1978 | Kreitner | |
| 4,541,394 | A | 9/1985 | Schechter et al. | |
| 4,583,509 | A | 4/1986 | Schechter et al. | |
| 4,632,230 | A | 12/1986 | Bilharz et al. | |
| 5,094,216 | A | 3/1992 | Miyaki et al. | |
| 5,133,645 | A | 7/1992 | Crowley et al. | |
| 6,224,350 | B1 | 5/2001 | Guentert et al. | |
| 2004/0109768 | A1 * | 6/2004 | Sommars et al. | 417/307 |

FOREIGN PATENT DOCUMENTS

| | | | |
|---|---|---|---|
| DE | 10036773 | B4 | 1/2004 |
| EP | 0516916 | B1 | 2/1996 |
| EP | 1251272 | A2 | 10/2002 |
| EP | 1253313 | A1 | 10/2002 |
| EP | 1350948 | A1 | 10/2003 |
| EP | 1429020 | | 6/2004 |
| JP | 62107280 | A | 5/1987 |

OTHER PUBLICATIONS

English translation of Office Action in Chinese Application 200510128732 mailed Aug. 15, 2008 (8 pgs.).

* cited by examiner

*Primary Examiner*—Devon Kramer
*Assistant Examiner*—Peter J Bertheaud
(74) *Attorney, Agent, or Firm*—Finnegan, Henderson, Farabow, Garrett & Dunner

(57) ABSTRACT

A pump has a housing defining a first pumping chamber and a second pumping chamber. The pump also has a first plunger and a second plunger. The pump additionally has at least one driver operatively engaged with at least one of the first and second plungers to move the at least one of the first and second plungers between first and second end positions. The pump further has a common spill passageway fluidly connectable to the first and second pumping chambers and a selector valve disposed between the common spill passageway and the first and second pumping chambers. The selector valve has a body and a ball valve member operably disposed within the body. The ball valve member is movable between a first and a second ball valve member position to selectively fluidly connect the first and second pumping chambers to the common spill passageway.

20 Claims, 3 Drawing Sheets

VARIABLE DISCHARGE FUEL PUMP

TECHNICAL FIELD

The present disclosure relates generally to a fuel pump, and more particularly to a variable discharge fuel pump.

BACKGROUND

A variable discharge fuel pump is utilized to maintain a pressurized fuel supply for a plurality of fuel injectors in a common rail fuel system. For example, U.S. Patent Publication No. 2004/0109768 (the '768 publication) to Sommars et al. teaches a variable discharge high-pressure pump for use in a common rail fuel injection system. In such common rail systems, the pump supplies fuel to the common rail, which in turn supplies the fuel to the injectors when the injectors are energized. The pump serves to maintain the common rail at a desired pressure and does so by associating a pressure driven disk-type shuttle valve with each pump chamber. When one of the pump pistons is undergoing its pumping stroke, the fuel displaced by the piston presses against the shuttle valve to open a passageway allowing fuel to flow to the common rail.

However, because the pump of the '768 publication uses a disk-type shuttle valve, the pump may be expensive and difficult to produce. In particular, the valve seating surfaces that mate with the shuttle valve disk are formed through a time consuming Electrical Discharge Machining (EDM) process, which utilizes expensive manufacturing equipment. The amount of time required to produce the disk-type shuttle valve seating surfaces, in conjunction with expensive EDM manufacturing equipment, can increase the cost of the pump. In addition, high temperatures associated with EDM processes can adversely affect material properties of the shuttle valve surfaces.

Further, because the disk-type shuttle valve relies on surface sealing, tight process tolerances may be required to produce the desired sealing characteristics. These tight process tolerances can further increase the cost of the pump.

The disclosed fuel pump is directed to overcoming one or more of the problems set forth above.

SUMMARY OF THE INVENTION

In one aspect, the present disclosure is directed to a pump that includes a housing defining a first pumping chamber and a second pumping chamber. The pump also includes a first plunger slidably disposed within the first pumping chamber and movable between first and second spaced apart end positions to pressurize a fluid, and a second plunger slidably disposed within the second pumping chamber and movable between first and second spaced apart end positions to pressurize the fluid. The pump further includes at least one driver operatively engaged with at least one of the first and second plungers to move the at least one of the first and second plungers between the first and second end positions. The pump additionally includes a common spill passageway fluidly connectable to the first and second pumping chambers and a selector valve disposed between the common spill passageway and the first and second pumping chambers. The selector valve has a body and a ball valve member operably disposed within the body. The ball valve member is movable between a first and second ball valve position to selectively fluidly connect the first and second pumping chambers to the common spill passageway.

In another aspect, the present disclosure is directed to a method of operating a pump. The method includes moving a first plunger within a first pumping chamber from a second end position to a first end position to draw a fluid into the first pumping chamber, and moving the first plunger from the first end position to the second end position to pump the fluid through a common spill passageway. The method further includes moving a second plunger within a second pumping chamber from a second end position to a first end position to draw a fluid into the second pumping chamber, and moving the second plunger from the first end position to the second end position to pump the fluid through the common spill passageway. The method also includes moving a ball valve member within a selector valve body between a first position and a second position to selectively fluidly communicate the first and second pumping chambers with the common spill passageway.

DETAILED DESCRIPTION

Figure 1:
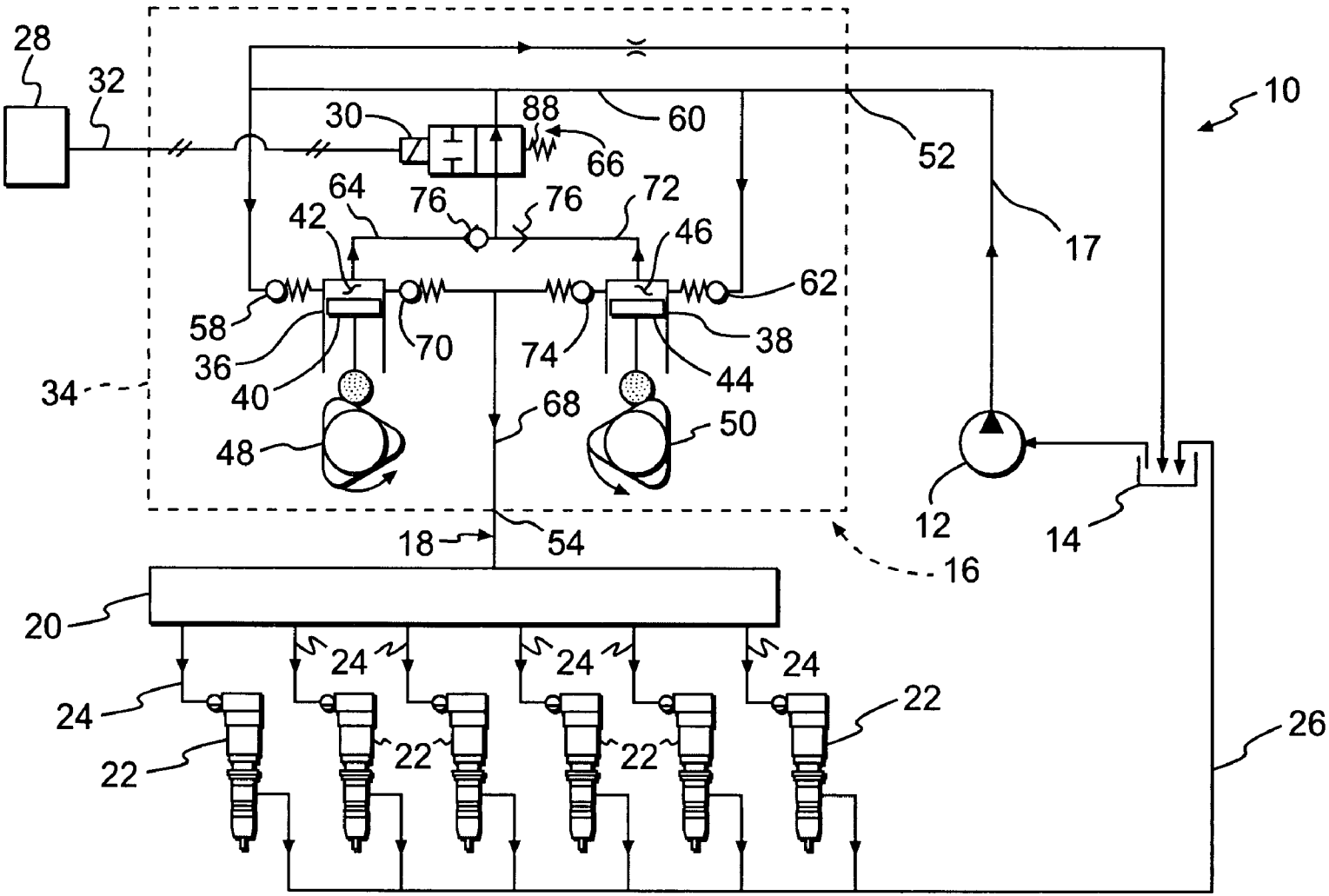
FIG. 1 is a schematic illustration of a common rail fuel system according to an exemplary embodiment of the present disclosure.

Referring to FIG. 1, a fuel system 10 includes a fuel transfer pump 12 that may transfer fuel from a low pressure reservoir 14 to a high-pressure pump 16 via a fluid passageway 17. High-pressure pump 16 may pressurize the fuel and direct the pressurized fuel through fluid passageway 18 to a fuel rail 20 that is in fluid communication with a plurality of fuel injectors 22 via fluid passageways 24. Fuel injectors 22 may be fluidly connected to reservoir 14 via a leak return passageway 26. An electronic control module 28 may be in communication with an actuator 30 connected to high-pressure pump 16 via a control communication line 32, and with individual fuel injectors 22 via additional communication lines (not shown).

High-pressure pump 16 may include a housing 34 defining a first and second barrel 36, 38. High-pressure pump 16 may also include a first plunger 40 slidably disposed within first barrel 36. First barrel 36 and first plunger 40 together may define a first pumping chamber 42. High-pressure pump 16 may also include a second plunger 44 slidably disposed within second barrel 38. Second barrel 38 and second plunger 44 together may define a second pumping chamber 46. It is contemplated that additional pumping chambers may be included within high-pressure pump 16.

A first and second driver 48, 50 may be operably connected to first and second plungers 40, 44, respectively. First and second drivers 48, 50 may include any means for driving first and second plungers 40, 44 such as, for example, a cam, a solenoid actuator, a piezo actuator, a hydraulic actuator, a motor, or any other driving means known in the art. A rotation of first driver 48 may result in a corresponding reciprocation of first plunger 40, and a rotation of second driver 50 may result in a corresponding reciprocation of second plunger 44. First and second drivers 48, 50 may be positioned relative to each other such that first and second plungers 40, 44 are caused to reciprocate out of phase with one another. First and second drivers 48, 50 may each include three lobes such that one rotation of a pump shaft (not shown) connected to first and second drivers 48, 50 may result in six pumping strokes. Alternately, first and second drivers 48, 50 may include a different number of lobes rotated at a rate such that pumping activity is synchronized to fuel injection activity. It is contemplated that a single driver may be configured to drive both first and second plungers 40, 44.

High-pressure pump 16 may include an inlet 52 fluidly connecting high-pressure pump 16 to fluid passageway 17. High-pressure pump 16 may also include a low-pressure gallery 60 in fluid communication with inlet 52 and in selective communication with first and second pumping chambers 42, 46. A first inlet check valve 58 may be disposed between low-pressure gallery 60 and first pumping chamber 42 and may be configured to allow a flow of low-pressure fluid from low-pressure gallery 60 to first pumping chamber 42. A second inlet check valve 62 may be disposed between low-pressure gallery 60 and second pumping chamber 46 and may be configured to allow a flow of low-pressure fluid from low-pressure gallery 60 to second pumping chamber 46.

High-pressure pump 16 may also include an outlet 54, fluidly connecting high-pressure pump 16 to fluid passageway 18. High-pressure pump 16 may include a high-pressure gallery 68 in selective fluid communication with first and second pumping chambers 42, 46 and outlet 54. A first outlet check valve 70 may be disposed between first pumping chamber 42 and high-pressure gallery 68 and may be configured to allow a flow of fluid from first pumping chamber 42 to high-pressure gallery 68. A second outlet check valve 74 may be disposed between second pumping chamber 46 and high pressure gallery 68 and may be configured to allow a flow of fluid from second pumping chamber 46 to high-pressure gallery 68.

High-pressure pump 16 may also include a first spill passageway 64 selectively fluidly connecting first pumping chamber 42 and a second spill passageway 72. A spill control valve 66 may be disposed within a common spill passageway 73 between first and second spill passageways 64, 72 and low-pressure gallery 60 and may be configured to selectively allow a flow of fluid from first and second spill passageways 64, 72 to low-pressure gallery 60.

Figure 2:
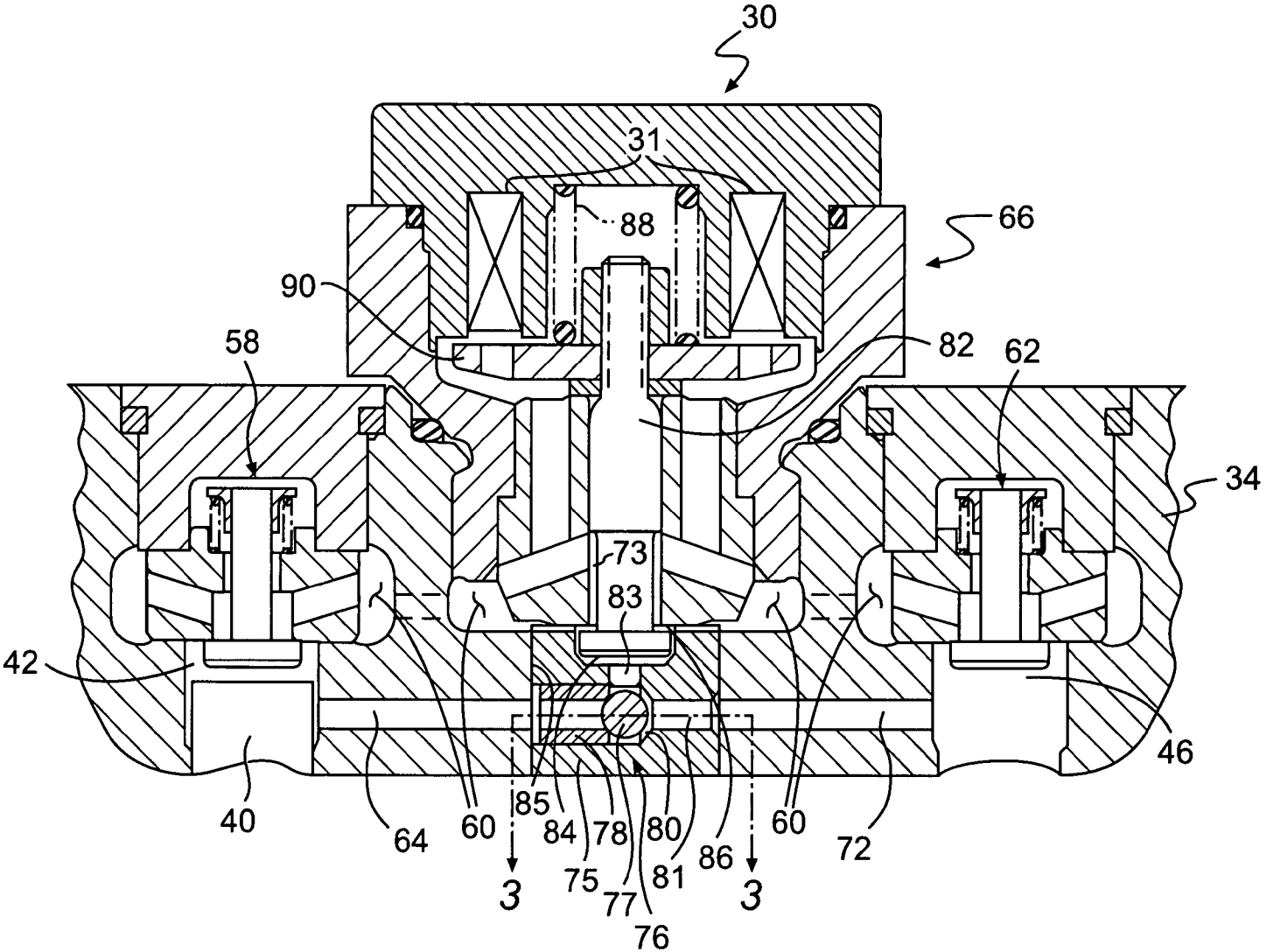
FIG. 2 is an enlarged cross-sectional view of a fill and spill portion of the pump of the system of FIG. 1.
Figure 3:
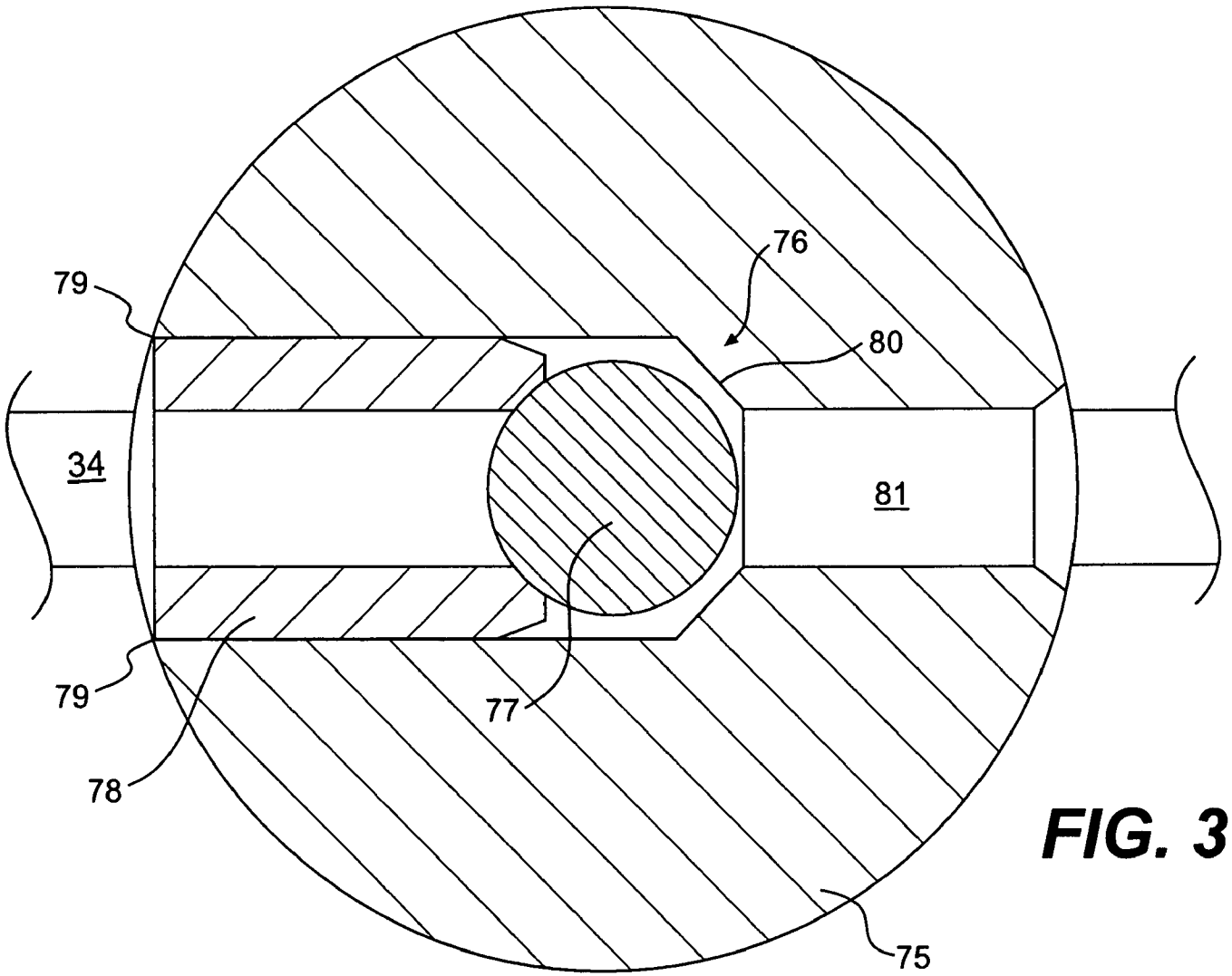
FIG. 3 is an enlarged cross-sectional view of a selector valve portion of the fill and spill portion of FIG. 2.

As illustrated in FIG. 2, the fluid connection between pumping chambers 42, 46 and low pressure gallery 60 may be established by a selector valve 76 having a valve body 75, a ball valve member 77, a first valve seat 78, and a second valve seat 80, which is oriented in opposition to first valve seat 78. Second valve seat 80 may be integral to valve body 75 and disposed within a through fluid passageway 81 of valve body 75, while first valve seat 78 may be pressed into through fluid passageway 81 during assembly. As illustrated in FIG. 3, the length of first valve seat 78 is selected to make two point contacts 79 with housing 34 so that first valve seat 78 is constrained from moving out of selector valve 76 under the influence of pumping pressure forces. Referring to FIG. 2, ball valve member 77 may be disposed within fluid passageway 81 and free to oscillate between first and second valve seats 78, 80 to selectively allow fluid to flow from one of first and second pumping chambers 42, 46 to common spill passageway 73 via a fluid passageway 83. The spacing between valve seats 78 and 80 may be such that ball valve member 77 never blocks all fluid from fluid passageway 83. It is contemplated that both first and second valve seats 78, 80 may alternately be separate from valve body 75 and connected to valve body 75 during assembly. It is further contemplated that the separate valve seats may be connected to valve body 75 by means other than pressing such as, for example, by threaded fastening, by welding, by chemical bonding, or by any other means known in the art. After assembly of ball valve member 77 and first valve seat 78, valve body 75 may be pressed into a bore 85 within housing 34. It is contemplated that valve body 75 may be connected to housing 34 by means other than pressing such as, for example, threaded fastening, welding, chemical bonding, or any other means known in the art.

Only one of first and second pumping chambers 42, 46 may be fluidly connected to low pressure gallery 60 at a time. Because first and second plungers 40, 44 may move out of phase relative to one another, one pumping chamber may be at high-pressure (pumping stroke) when the other pumping chamber is at low-pressure (intake stroke), and vice versa. This action may be exploited to move ball valve member 77 back and forth to fluidly connect either first spill passageway 64 to spill control valve 66, or second spill passageway 72 to spill control valve 66. Thus, first and second pumping chambers 42, 46 may share a common spill control valve 66.

For example, when first plunger 40 moves through a pumping stroke and second plunger 44 moves through an intake stroke, ball valve member 77 may be in the position illustrated in FIG. 2, in which first pumping chamber 42 is fluidly connected to spill control valve 66. The fluid connection between first pumping chamber 42 and spill control valve 66 is created when fluid, pressurized by first pumping chamber 42 acting on ball valve member 77, pushes ball valve member 77 to engage valve seat 80 and close second spill passageway 72 from spill control valve 66. In similar fashion, as second plunger 44 moves through the pumping stroke and first plunger 40 moves through the intake stroke, ball valve member 77 may move to engage valve seat 78, thereby connecting second spill passageway 72 to spill control valve 66, while low-pressure fuel is drawn into first pumping chamber 42 past first inlet check valve 58.

Spill control valve 66 may include a spill valve member 82 having a hydraulic surface 84 that produces a latching affect when spill valve member 82 is in contact with a valve seat 86. Spill valve member 82 may be normally biased toward a first position where fluid is allowed to flow past spill valve member 82, as shown in FIG. 2, via a biasing spring 88. Spill valve member 82 may also be moved to a second position where fluid is blocked from flowing past spill valve member 82 by energizing actuator 30. Actuator 30 may include a solenoid 31 configured to attract an armature 90 coupled to spill valve member 82 when solenoid 31 is energized, thereby closing spill valve member 82. One skilled in the art will recognize that actuator 30 may be any type of actuator known in the art such as for example, a piezo and/or piezo bender actuator.

Control signals generated by electronic control module 28 directed to high-pressure pump 16 via communication line 32 may determine when and how much fuel is pumped into fuel rail 20. Control signals generated by electronic control module 28 directed to fuel injectors 22 may determine the actuation timing and actuation duration of fuel injectors 22.

Electronic control module 28 may include all the components required to perform the required system control such as, for example, a memory, a secondary storage device, and a processor, such as a central processing unit. One skilled in the art will appreciate that electronic control module 28 can contain additional or different components. Associated with electronic control module 28 may be various other known circuits such as, for example, power supply circuitry, signal conditioning circuitry, and solenoid driver circuitry, among others.

INDUSTRIAL APPLICABILITY

The disclosed pump finds potential application in any fluid system where it is desirous to control discharge from a pump. The disclosed pump finds particular applicability in fuel injection systems, especially common rail fuel injection systems. One skilled in the art will recognize that the disclosed pump could be utilized in relation to other fluid systems that may or may not be associated with an internal combustion engine. For example, the disclosed pump could be utilized in relation to fluid systems for internal combustion engines that use a hydraulic medium, such as engine lubricating oil. The fluid systems may be used to actuate various sub-systems such as, for example, hydraulically actuated fuel injectors or gas exchange valves used for engine braking. A pump according to the present disclosure could also be substituted for a pair of unit pumps in other fuel systems, including those that do not include a common rail.

Referring to FIG. 1, when fuel system 10 is in operation, first and second drivers 48, 50 rotate causing first and second plungers 40, 44 to reciprocate within respective first and second barrels 36, 38, out of phase with one another. When first plunger 40 moves through the intake stroke, second plunger 44 moves through the pumping stroke.

During the intake stroke of first plunger 40, fluid is drawn into first pumping chamber 42 via first inlet check valve 58. As first plunger 40 begins the pumping stroke, fluid pressure causes ball valve member 77 to engage valve seat 80 and allow displaced fluid to flow from first pumping chamber 42 through spill control valve 66 to low-pressure gallery 60. When it is desirous to output high-pressure fluid from high-pressure pump 16, solenoid 31 of actuator 30 may be energized to move spill valve member 82 toward solenoid 31 and close spill control valve 66.

Closing spill control valve 66 may cause an immediate build up of pressure within first pumping chamber 42. After the pressure increases beyond a minimum threshold, solenoid 31 may be de-energized and the force generated by the build up of pressure against hydraulic surface 84 firmly holds spill control valve 66 in a closed position. As the pressure continues to increase within first pumping chamber 42, a pressure differential across first outlet check valve 70 produces an opening force on outlet check valve 70 that exceeds a spring closing force of outlet check valve 70. When the spring closing force of first outlet check valve 70 has been surpassed, first outlet check valve 70 opens and high-pressure fluid from within first pumping chamber 42 flows through first outlet check valve 70 into high-pressure gallery 68 and then into fuel rail 20 by way of fluid passageway 18.

One skilled in the art will appreciate that the timing at which actuator 30 is energized determines what fraction of the amount of fluid displaced by the first plunger 40 is pumped into the high-pressure gallery 68 and what is pumped back to low-pressure gallery 60. This operation serves as a means by which pressure can be maintained and controlled in fuel rail 20. As noted in the previous section, control of the energizing of actuator 30 is provided by signals received from electronic control module 28 over communication line 32.

Toward the end of the pumping stroke, as the angle of the portion of first driver 48 causing first plunger 40 to move decreases, the reciprocating speed of first plunger 40 proportionally decreases. As the reciprocating speed of plunger 40 decreases, the opening force caused by the pressure differential across first outlet check valve 70 nears and then falls below the spring force of first outlet check valve 70. First outlet check valve 70 moves to the closed position to block fluid through first outlet check valve 70 when the opening force caused by the pressure differential across first outlet check valve 70 falls below the spring force of first outlet check valve 70.

After first plunger 40 completes the pumping stroke and begins moving in the opposite direction during the intake stroke, the pressure of the fluid within first pumping chamber 42 creates a force caused by the pressure differential across spill valve member 82 that nears and then falls below the force exerted by biasing spring 88. As the pressure differential across spill valve member 82 becomes less than the spring force of biasing spring 88, biasing spring 88 moves spill valve member 82 from solenoid 31 to the open position.

As second plunger 44 switches modes from filling to pumping (and first plunger 40 switches from pumping to filling), ball valve member 77 moves to the other side of its cavity engaging valve seat 78 to block fluid flow from first pumping chamber 42 and opening the path between pumping chamber 46 and spill control valve 66, thereby allowing spill control valve 66 to control the discharge of second pumping chamber 46. Second plunger 44 then completes a pumping stroke similar to that described above with respect to first plunger 40.

Several advantages are realized because selector valve 76 is a ball-type selector valve. The geometry of valve body 75 that accommodates ball valve member 77 may be simple allowing for conventional manufacturing processes and equipment. Implementing conventional manufacturing processes and equipment may result in a pump that is less expensive and takes less time to produce. In addition, because ball valve member 77 relies on line sealing rather than surface sealing, less restrictive manufacturing tolerances may be implemented that result in further reduced manufacturing time and cost.

It will be apparent to those skilled in the art that various modifications and variations can be made to the pump of the present disclosure. Other embodiments of the pump will be apparent to those skilled in the art from consideration of the specification and practice of the invention disclosed herein. It is intended that the specification and examples be considered as exemplary only, with a true scope of the invention being indicated by the following claims and their equivalents.

What is claimed is:

1. A pump comprising:

a pump housing including;

a first pumping chamber, a second pumping chamber substantially parallel to the first pumping chamber, a substantially cylindrical bore, located between the first and the second pumping chamber, extending from an outside surface of the housing into the housing, the bore being substantially parallel to the first and the second pumping chamber and having a curved side wall and an end face;

a first fluid passageway coupling the first pumping chamber with the bore, the first fluid passageway intersecting the curved sidewall of the bore;

a second fluid passageway coupling the second pumping chamber to the bore, the second fluid passageway intersecting the curved sidewall of the bore;

a common spill passageway extending coaxially from the end face of the bore into the housing; and a substantially cylindrical selector valve fixedly coupled to the bore, the selector valve including;

a curved external surface forming a mating surface with the curved surface of the bore, a through fluid passageway extending from one side of the curved external surface to an opposite side of the curved external surface, the through fluid passageway coupling the first and second fluid passageway and being substantially coaxial with the first and second fluid passageway;

a third fluid passageway coupling the through fluid passageway to the common spill passageway, the third fluid passageway being substantially perpendicular to the through fluid passageway; and a ball valve member disposed in the through fluid passageway, the ball valve member being movable between a first and a second ball valve position to selectively couple one of the first and second fluid passageways to the common spill passageway.

2. The pump of claim 1, wherein the third fluid passageway includes a first section proximate the ball valve member and a second section proximate the end face of the bore, the second section having a larger diameter than the first section.

3. The pump of claim 2, further including a spill control valve extending from the common spill passageway and configured to move in the second section from a first spill control valve position to a second spill control valve position, the first spill control valve position being a position where the third fluid passageway is fluidly coupled with the common spill passageway and the second spill control valve position being a position where the spill control valve mates with the end face of the bore and fluidly decouples the third fluid passageway and the common spill passageway.

4. The pump of claim 1, wherein the selector valve further includes:

a first valve seat; and a second valve seat, the ball valve member being disposed between the first and second valve seats and configured to selectively engage the first and second valve seats.

5. The pump of claim 4, wherein the first valve seat is a separate part that is attached to the selector valve.

6. The pump of claim 5, wherein the second valve seat is integral with the selector valve.

7. The pump of claim 5, wherein the first valve seat is attached to the selector valve by one of pressing, threaded fastening, welding and chemical bonding.

8. The pump of claim 4, wherein the first valve seat has at least one point of contact with the housing.

9. The pump of claim 1, further including a high-pressure outlet in fluid communication with the first and second pumping chambers.

10. The pump of claim 1, wherein the selector valve is fixedly coupled to the bore by one of pressing, threaded fastening, welding, or chemical bonding.

11. The pump of claim 1, further including a first plunger slidably disposed within the first pumping chamber and a second plunger slidably disposed within the second pumping chamber, the first plunger and the second plunger configured to assist in pressurizing a fluid.

12. The pump of claim 11, wherein the first plunger is configured to reciprocate out of phase with the second plunger.

13. The pump of claim 11, further including a first driver engaged with the first plunger to reciprocate the first plunger between two end points of the first pumping chamber, and a second driver engaged with the second plunger to reciprocate the second plunger between two end points of the second pumping chamber.

14. The pump of claim 13, wherein the first driver and the second driver are each one of a cam, a solenoid actuator, a piezo actuator, a hydraulic actuator, and a motor.

15. The pump of claim 13, wherein a rotation of the first driver results in a reciprocatory motion of the first plunger, and a rotation of the second driver results in a reciprocatory motion of the second plunger.

16. The pump of claim 1, further including a low pressure gallery in selective fluid communication with the first pumping chamber and the second pumping chamber.

17. The pump of claim 16, further including a first inlet check valve between the first pumping chamber and the low pressure gallery, the first inlet check valve being configured to allow flow of a fluid from the low pressure gallery to the first pumping chamber.

18. The pump of claim 17, further including a second inlet check valve between the second pumping chamber and the low pressure gallery, the second inlet check valve being configured to allow flow of the fluid from the low pressure gallery to the second pumping chamber.

19. The pump of claim 1, further including a high pressure gallery in selective fuel communication with the first pumping chamber and the second pumping chamber.

20. The pump of claim 19, further including a first outlet check valve between the first pumping chamber and the high pressure gallery and a second outlet check valve between the second pumping chamber and the high pressure gallery, the first outlet check valve configured to allow flow of a fluid from the first pumping chamber to the high pressure gallery and the second outlet check valve configured to allow flow of the fluid from the second pumping chamber to the high pressure gallery.

* * * * *